United States Patent [19]

Reetz

[11] Patent Number: 4,750,309

[45] Date of Patent: Jun. 14, 1988

[54] STRUCTURAL SUPPORT BRACKET

[75] Inventor: William R. Reetz, Boise, Id.

[73] Assignee: Trus Joist Corporation, Boise, Id.

[21] Appl. No.: 834,534

[22] Filed: Feb. 28, 1986

[51] Int. Cl.[4] ..... E04C 3/02

[52] U.S. Cl. ..... 52/693; 52/690

[58] Field of Search ..... 52/690, 692, 693, 694; 403/398, 399, 400

[56] References Cited

U.S. PATENT DOCUMENTS

| | | | |
|---|---|---|---|
| 1,178,610 | 4/1916 | Weiss | 403/399 |
| 3,137,899 | 6/1964 | Troutner | 20/5 |
| 3,268,251 | 8/1966 | Troutner | 287/20.92 |
| 3,330,087 | 7/1967 | Troutner | 52/693 |
| 3,422,591 | 1/1969 | Troutner | 52/693 |
| 3,570,204 | 3/1971 | Birkemier | 52/289 |
| 3,857,218 | 12/1974 | Gilb | 52/694 |
| 4,106,257 | 8/1978 | Glib | 52/693 |
| 4,467,579 | 8/1984 | Weinar | 52/489 |
| 4,592,186 | 6/1986 | Braginetz | 403/400 |

OTHER PUBLICATIONS

"Web Joist", an Advertising Brochure of Pacific Roof Structures, 500 West Grove Avenue, Orange, Calif. 92665.

9/11/85 Drawing of Web Joist Heel Connection Assembly.

*Primary Examiner*—Henry E. Raduazo

*Attorney, Agent, or Firm*—Klarquist, Sparkman, Campbell, Leigh & Whinston

[57] ABSTRACT

A bracket apparatus for attachment of a structural support, such as a truss, receives a pin in the form of a bolt which extends laterally through side edges of chord members of the support and a hole in a web member. The bracket apparatus includes two cooperating bracket members each including an upper plate portion, an internal tab portion, and external flange portion which extends in the same direction as the tab portion generally perpendicular from the upper plate portion. The tab portion and flange portion include holes which receive the pin extending laterally through the chord member. The bracket apparatus provides additional support to the pin in providing additional bearing surfaces in the form of the inner surface of the holes in the tab portion and external portion and thus reduces the amount of pin bending. Accordingly, lower grade steel can be used in the pin or a higher reaction load can be carried by the truss for a given pin.

8 Claims, 2 Drawing Sheets

STRUCTURAL SUPPORT BRACKET

BACKGROUND OF THE INVENTION

This invention relates generally to brackets for web type structural support members and more specifically to brackets for attachment of a joist or truss to a support. Such truss mounting brackets are especially useful with open web trusses.

Open web trusses are generally comprised of upper and lower chord members of wood which are interconnected by a plurality of metal web members arranged in zig-zag fashion between the chord members. Such trusses are generally attached to support structures at the ends of their upper chord members near the area where the end web member joins the upper chord member.

Numerous devices are available for attaching the end of the upper chord members to a support. Known devices for supporting such trusses are shown for example in U.S. Pat. Nos. 3,137,899 to Troutner, 3,268,251 to Troutner, 3,330,087 to Troutner, and 3,570,204 to Birkemier. Each of these references discloses open web trusses with coupling pins extending through the chord members and the web members. Two L-shaped bracket members are employed at the end of the truss, an inner leg portion of which is received in a centrally disposed slot in the upper chord member of the truss. A hole extends laterally through the upper chord member and a slot also extends vertically therethrough in alignment with holes in the inner legs of the two bracket members extending into the slot and with a hole in the end of the last web member which also extends into the slot from the underside of the upper chord member. A bolt or pin extends through the axially aligned holes thus attaching the end web member to the upper chord member and bracket. The brackets thereby reinforce the ends of the truss and in one embodiment eliminate the need for notching the support wall bearing plate or beam to provide clearance for the end web members.

The end pins in such trusses are subjected to a substantial amount of force resulting from the end web member being in compression or tension. If the force becomes great enough, the pin will have a tendency to bend which induces wood failure and could lead to collapse of the truss. This problem is solved by the truss bracket of the present invention.

SUMMARY OF THE INVENTION

Accordingly, it is one object of the present invention to enable open web type structural support members, such as trusses, to carry a greater load.

Another object of the present invention is to provide an improved truss bracket apparatus which reduces the amount of pin bending.

A further object of the present invention is to provide such a bracket apparatus which eliminates the need to notch the support wall bearing plate to provide clearance for the end web members.

An additional object is to provide a bracket apparatus which acts together with the chord member to more effectively transfer the load to the wall bearing plate.

A still further object of the present invention is to provide a bracket apparatus for a truss which is easy to manufacture and install.

These and other objects, advantages and features of the present invention will be better understood by the following detailed description of preferred embodiments which thereof proceed with reference to the accompanying drawings.

DETAILED DESCRIPTION

Figure 1:
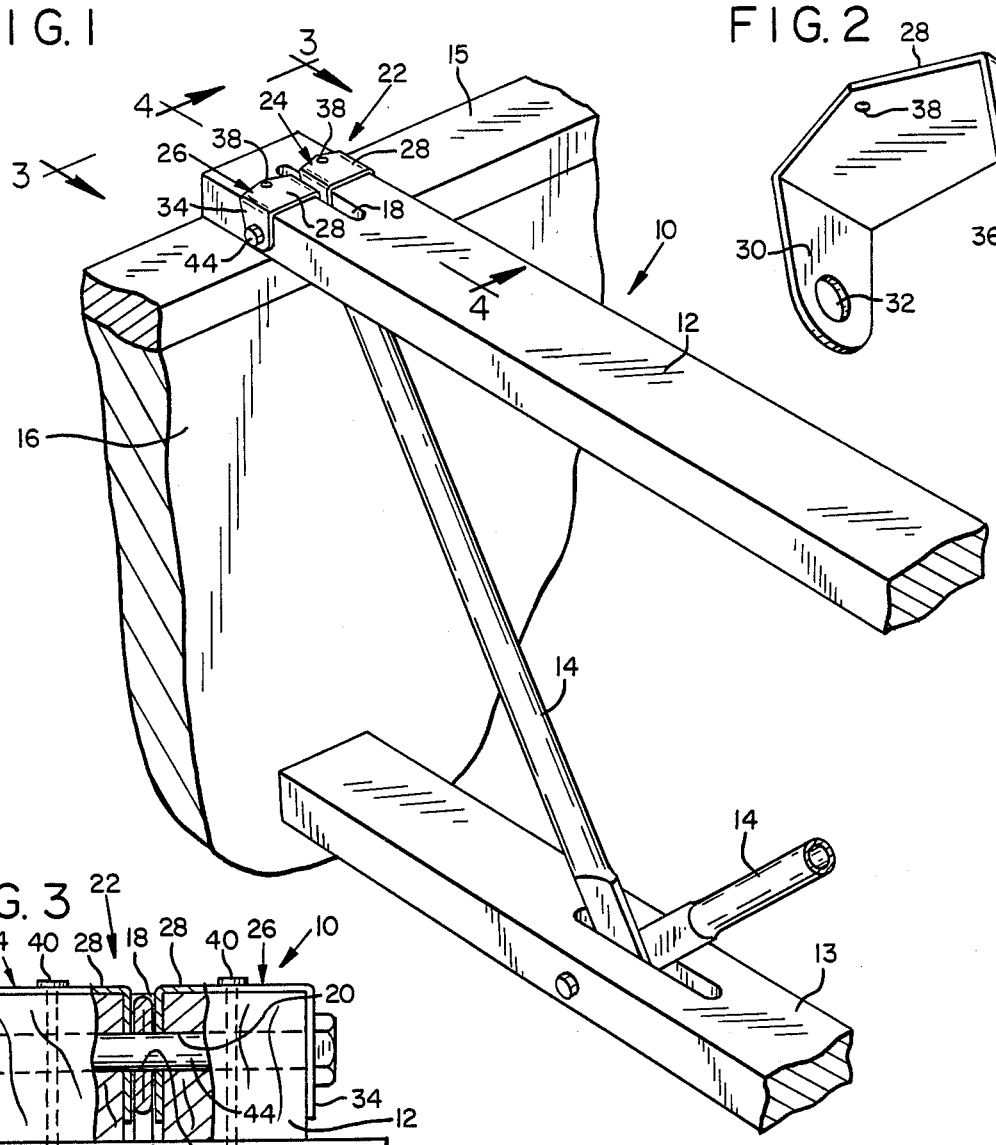
FIG. 1 is a perspective side elevation view of a truss installation employing one embodiment of the bracket apparatus of the present invention.
Figure 2:
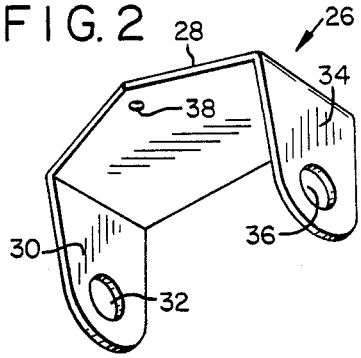
FIG. 2 is a perspective bottom view of a portion of the bracket apparatus of FIG. 1.

Referring to FIGS. 1 to 4, one embodiment of the invention comprises a structural support member, such as a truss 10, of the open web type which includes an upper chord member 12 and a lower chord member 13, both of wood joined by a plurality of metal web members 14. Upper chord member 12 is mounted on a bearing plate 15 of wood which is mounted to the top of a support wall 16 which may be of concrete. Upper chord member 12 includes a bracket mounting slot 18 which extends vertically through such chord member adjacent one end thereof and a hole 20 extending horizontally through the side of the chord member and through slot 18.

A truss bracket apparatus 22 in accordance with the invention includes two cooperating U-shaped bracket members 24, 26 extending into slot 18. As shown, bracket members 24, 26 are identical in shape although this is not necessary as more fully described below. Each bracket member includes an upper plate portion 28 and an internal leg or tab portion 30 extending downwardly from an inner edge thereof. Internal tab portion 30 is wider at its top than its bottom for evenly distributing stress across the top of the bracket member. Tab portion 30 is of a proper size to extend into slot 18 in upper chord member 12 and has a hole 32 extending therethrough. Hole 32 is positioned to be aligned with laterally extending hole 20 in upper chord member 12 when bracket 26 bears against the upper surface of upper chord member 12. Bracket 26 also has an external leg shown in the form of a downwardly extending flange portion 34 connected to an outer edge of upper plate portion 28. Flange portion 34 includes a hole 36 which when mounted is axially aligned with hole 20 in chord member 12 and hole 32 in internal tab portion 30.

Figure 3:
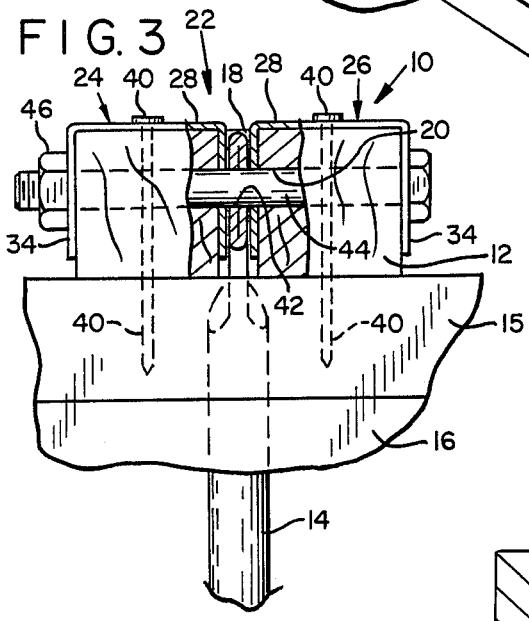
FIG. 3 is an enlarged section view taken along line 3—3 in FIG. 1.

Upper plate portion 28 includes an attachment means for securing the bracket member to upper chord member 12 and support 16. The attachment means is preferably in the form of a nail hole 38 in upper surface 28 located outward of the vertical plane containing the axial center-line extending through holes 32, 36 in portions 30, 34 respectively. Hole 38 receives a nail 40 which is hammered through upper chord member 12 and into a bearing plate 15, as best shown in FIG. 3.

Figure 4:
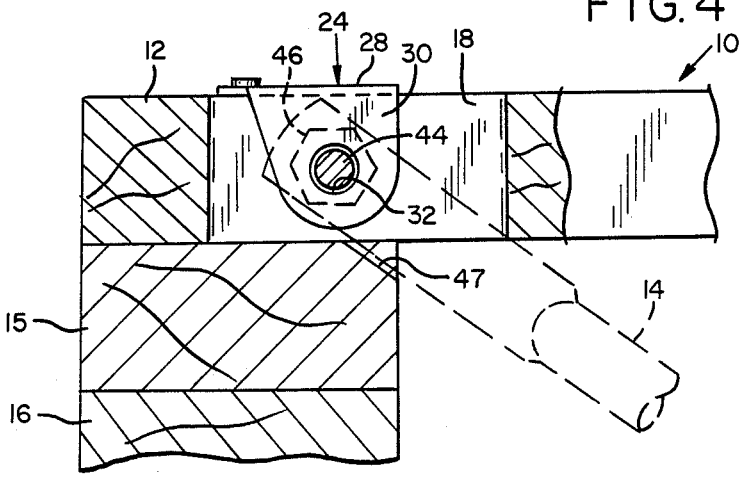
FIG. 4 is an enlarged section view taken along lines 4—4 in FIG. 1.
Figure 5:
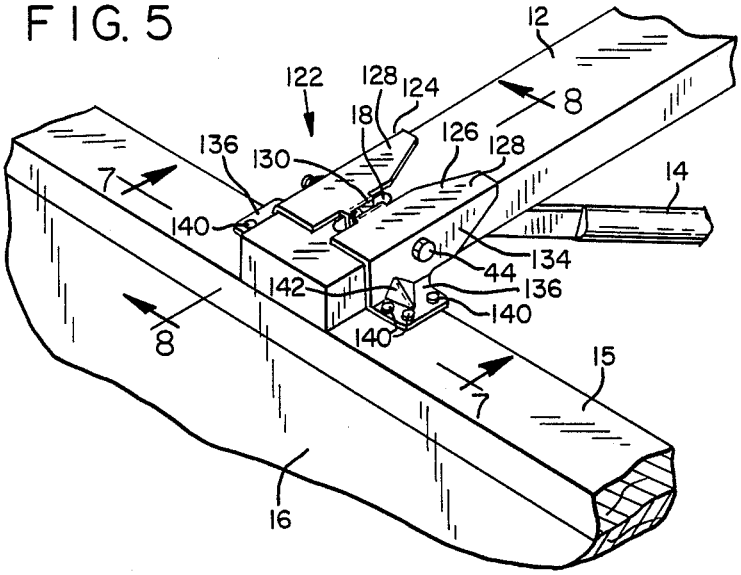
FIG. 5 is a perspective elevational view of the upper chord member of a truss employing a second embodiment of a truss bracket apparatus in accordance with the invention.
Figure 6:
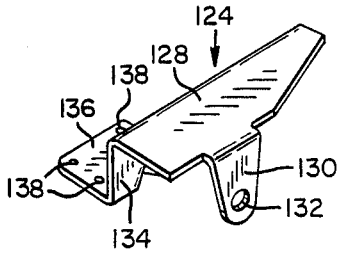
FIG. 6 is a perspective view of a portion of the bracket apparatus of FIG. 5.
Figure 7:
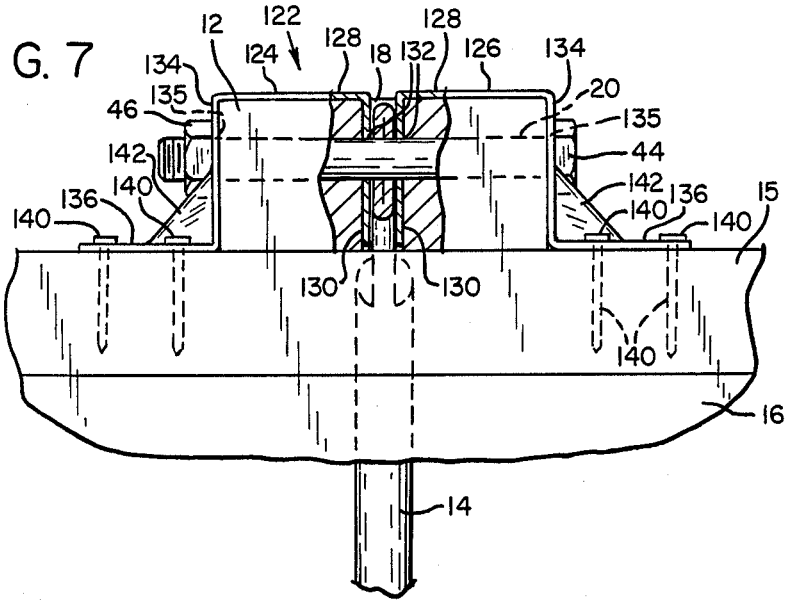
FIG. 7 is an enlarged section view taken along the line 7—7 in FIG. 5.
Figure 8:
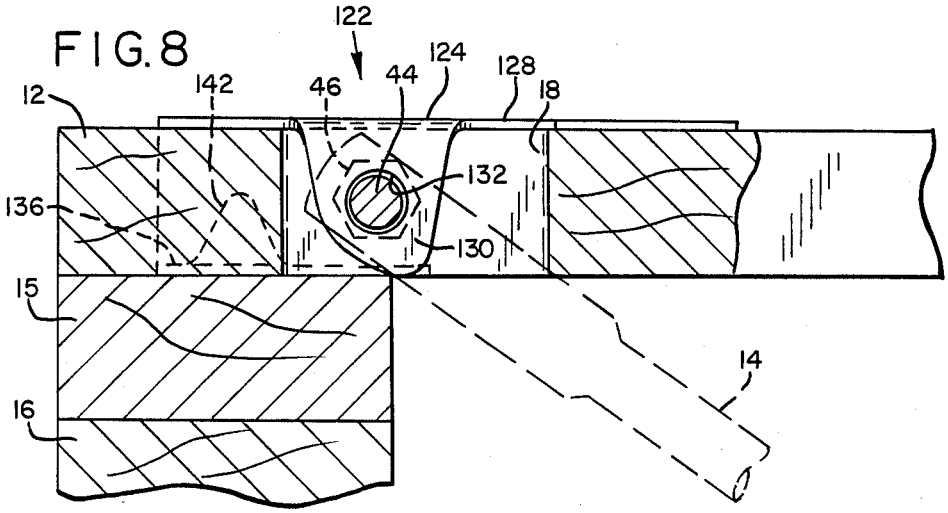
FIG. 8 is an enlarged section view taken along line 8—8 in FIG. 5.

The upper end of the last web member 14 at both ends of the truss 10 includes a hole 42 roughly the same size as holes 32, 36. The purpose of hole 42 in web member 14 is to provide a means for securing web member 14 to upper chord member 12. This is accomplished by employing fastening means which includes a fastening element such as a metal pin 44 which extends through holes 20, 32, 36, and 42. Pin 44 is preferably a bolt threaded at one end for receiving a locking nut 46. When so configured, the head of pin 44 and nut 46 hold the external flange portions 34 of each bracket against the side surfaces of upper chord member 12 and prevent the flange portions from spreading outward under load conditions. In this embodiment, notches 47 must be formed in the top inner edge of the bearing plate 15 to accomodate the end web members at the opposite ends of the truss, as shown in FIG. 4.

A truss supported at both ends by brackets in this manner reduces the amount of pin bending normally experienced by the pin for the last web member in prior art devices. This pin bending is reduced at the pin by, in addition to the pin bearing against the inner surface of lateral hole 20 in wood chord member 12, also bearing against the inner surface of holes 32, 36 in metal bracket members 24, 26. Thus, the bracket apparatus provides additional support for the pin. The pin head and nut keep the external flange portions from spreading outward, thus providing additional support for the bracket. By reducing pin bending, lower grade steel can be used in the pin or a higher reaction load can be carried by the truss for a given pin as it is pin bending that usually induces truss failure.

Also, it should be readily apparent that a plurality of such brackets would be usable all along the truss to provide additional support to each pin.

A second embodiment of a bracket apparatus in accordance with the invention is shown in FIGS. 5 to 8. In addition to the advantages of the above described design, this designed bracket apparatus allows the web of a truss to be positioned off the bearing plate and consequently eliminating the need for the notches in bearing plate 15.

The second embodiment of the bracket apparatus is designated generally as numeral 122. The bracket apparatus 122 includes two cooperating bracket members 124 and 126. Brackets 124, 126, while not being identical to one another, are mirror images of each other. In this manner the two bracket members are not identically shaped as they were in the first embodiment.

Each bracket member includes an elongate upper plate portion 128. An internal leg or tab portion 130 extends downwardly from an inner edge of upper plate portion 128 and includes a hole 132 which is axially aligned with laterally extending hole 20 in upper chord member 12. An external leg or flange portion in the form of a downwardly extending side portion 134 is connected at a top edge to an outer edge of upper plate portion 128. The side portion 134 includes a hole 135 which is axially aligned with hole 132. The external flange portion also includes a foot portion 136 which is connected to a bottom edge of side portion 134. Foot portion 136 extends perpendicularly outward from side portion 134 for bearing against the upper surface of bearing plate 15 on support wall 16. Attachment means in the form of nail holes 138 in foot portion 136 are included for receiving nails 140 which are driven through such holes into bearing plate 15 for securing the bracket and truss to support wall 16. A fastening element, such as a pin in the form of a bolt 44 and locking nut 46 as in the first described embodiment, extends through holes 132, 135 in bracket members 124 and 126 and holes 20 and 42 in chord member 12 and web member 14 and is used to secure web member 14 to the upper chord member.

The external flange portions 134, 136 also can include a gusset projection 142 formed in downwardly extending side portion 134 and foot portion 136 for strengthening each of the bracket members.

The design of this second embodiment forces the formed steel bracket to act as an angle when loaded which causes the bracket to act compositely with the wood chord member to effectively transfer load from the truss to the support 15, 16. The gusset projection effectively stiffens the external side portion 134 allowing the external side portion to transfer bearing loads to the support wall without bending. This has the effect of increasing the bearing load area of the upper chord member assembly and increases the load capacity of the truss.

Having illustrated and described the principles of my invention with reference to preferred embodiments, it should be apparent to those persons skilled in the art that such invention may be modified in arrangement and detail without departing from such principles. I claim as my invention all such modifications as come within the true spirit and scope of the following claims.

I claim:

1. A truss apparatus comprising, an upper chord member having two opposite side edges extending between a top and a bottom of said upper chord member;

a lower chord member;

a plurality of web members interconnecting said chord members and including an end web member;

the upper chord member having a slot extending therethrough adjacent one end thereof, the upper chord member further having a lateral hole substantially centrally located between the top and bottom of said upper chord member and extending laterally through side edges of the upper chord member and through said slot;

two cooperating bracket members, each bracket member including a plate portion positioned on the upper chord member, an internal tab portion extending from an inner edge of the plate portion and extending into said slot, said internal tab portion having a first hole extending therethrough which is axially aligned with the laterally extending hole in the upper chord member, an external flange portion, including a side portion connected at a first edge to an outer edge of the plate portion, said side portion positioned adjacent a side edge of the upper chord member and having a second hole extending therethrough, said second hole being axially aligned with the first hole extending through the internal tab portion and lateral hole in the upper chord member, and fastening means including a fastener element extending through said first and second holes in said bracket members, the lateral hole in the upper chord member, and a hole in the end web member for securing said end web member to said upper chord member so that the horizontal component of the load is transferred from the web member to the chord member through said fastener element, said fastener element being engaged adjacent its opposite ends by the external flange portions and being engaged at a mid-portion by the internal tab portions of said two bracket members.

2. The apparatus of claim 1 wherein said internal tab portion is wider at the top than the bottom portion thereof for evenly distributing stress across the top of the bracket member.

3. The apparatus of claim 1 in which the fastener element includes a pin.

4. The apparatus of claim 1 wherein the two internal tab portions of the two bracket members are positioned so that the end of the web member is between said two internal tab portions.

5. A truss apparatus comprising, an upper chord member having an upper face and two opposite side edges extending between a top and a bottom of said upper chord member;

a lower chord member;

a plurality of web members interconnecting said chord members and including an end web member;

the upper chord member having a slot extending therethrough in the upper face adjacent one end thereof, the upper chord member further having a lateral hole substantially centrally located between the top and bottom of said upper chord member and extending laterally through side edges of the upper chord member and through said slot;

two cooperating bracket members, each bracket member including:

(a) an upper plate portion positioned adjacent the upper surface of the upper chord member, (b) an internal tab portion extending downwardly from an inner edge of the upper plate portion and extending into said slot, said internal tab portion having a first hole extending therethrough which is axially aligned with the laterally extending hole in the upper chord member, (c) an external flange portion, including a downwardly extending side portion connected at a first edge to an outer edge of the upper plate portion, said side portion positioned adjacent a side edge of the upper chord member and having a second hole extending therethrough, said second hole being axially aligned with the first hole extending through the internal tab portion and lateral hole in the upper chord member, (d) a foot portion connected to a second edge of the side portion of said external flange portion opposite to the first edge of said side portion, said foot portion extending outward from the side portion and adapted to be secured to a top of the support; and fastening means including a fastener element extending through said first and second holes in said bracket members, the lateral hole in the upper chord member, and a hole in the end web member for securing said end web member to said upper chord member so that the horizontal component of the load is transferred from the web member to the chord member through said fastener element.

6. The apparatus of claim 5 wherein said external flange portion includes gusset means connected between said downwardly extending side portion and foot portion for strengthening said bracket members.

7. The apparatus of claim 5 wherein said bracket members each have attachment means for securing the bracket member to a support including nails extending through said foot portion.

8. The apparatus of claim 7 wherein said attachment means includes a hole in each upper plate portion of each bracket member which receives a nail which extends through said hole, said upper chord member, and into a top of a support.

* * * * *